US012025036B2

(12) United States Patent
Saggam et al.

(10) Patent No.: US 12,025,036 B2
(45) Date of Patent: Jul. 2, 2024

(54) CYLINDER DEACTIVATION MECHANISMS FOR PUSHROD VALVE TRAIN SYSTEMS AND ROCKER ARMS

(71) Applicant: Eaton Intelligent Power Limited, Dublin (IE)

(72) Inventors: Nikhil Kishor Saggam, Pune (IN); Matthew Adrian Vance, Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 55 days.

(21) Appl. No.: 17/797,197

(22) PCT Filed: Feb. 5, 2021

(86) PCT No.: PCT/EP2021/025043

§ 371 (c)(1),
(2) Date: Aug. 3, 2022

(87) PCT Pub. No.: WO2021/156008

PCT Pub. Date: Aug. 12, 2021

(65) Prior Publication Data

US 2023/0049929 A1 Feb. 16, 2023

(30) Foreign Application Priority Data

Feb. 7, 2020 (IN) ..... 202011005474
Aug. 20, 2020 (IN) ..... 202011035869

(51) Int. Cl.
*F01L 1/18* (2006.01)
*F01L 1/14* (2006.01)
(Continued)

(52) U.S. Cl.
CPC ..... *F01L 1/182* (2013.01); *F01L 1/146* (2013.01); *F01L 1/46* (2013.01); *F01L 13/0005* (2013.01);
(Continued)

(58) Field of Classification Search
CPC ..... F01L 2013/001; F01L 2001/467; F01L 2001/186; F01L 1/46; F01L 1/182; F01L 13/0005
See application file for complete search history.

(56) References Cited

U.S. PATENT DOCUMENTS 2,526,239 A 10/1950 Kincaid, Jr.
4,050,435 A 9/1977 Fuller, Jr. et al.
(Continued)

FOREIGN PATENT DOCUMENTS

CN 1617978 A 5/2005
CN 101255823 A 9/2008
(Continued)

OTHER PUBLICATIONS

International Search Report and Written Opinion for PCT/EP2021/025043 dated Jul. 30, 2021; pp. 1-20.
(Continued)

*Primary Examiner* — Ngoc T Nguyen
(74) *Attorney, Agent, or Firm* — Baker Botts L.L.P.

(57) ABSTRACT

A valvetrain assembly comprises a deactivatable rocker arm where a pushrod is configured to transfer a valve lift profile through to a valve end to a valve or valve bridge. A castellation assembly in a carrier and alternative two-piece rocker arm assemblies with rotary or linear actuators are shown for deactivating the transfer of the valve lift profile.

15 Claims, 15 Drawing Sheets

(51) Int. Cl.
*F01L 1/46* (2006.01)
*F01L 13/00* (2006.01)

(52) U.S. Cl.
CPC ... *F01L 2001/186* (2013.01); *F01L 2001/467* (2013.01); *F01L 2013/001* (2013.01)

(56) References Cited

U.S. PATENT DOCUMENTS

| | | | |
|---|---|---|---|
| 4,141,333 | A | 2/1979 | Gilbert |
| 4,200,081 | A | 4/1980 | Meyer et al. |
| 4,284,042 | A | 8/1981 | Springer |
| 4,380,219 | A | 4/1983 | Walsh |
| 4,763,616 | A | 8/1988 | Grinsteiner |
| 4,934,323 | A | 6/1990 | Grinsteiner |
| 5,038,726 | A | 8/1991 | Pryba |
| 5,960,755 | A | 10/1999 | Diggs et al. |
| 6,273,039 | B1 | 8/2001 | Church |
| 6,354,265 | B1 | 3/2002 | Hampton et al. |
| 6,516,760 | B2 | 2/2003 | Buglioni |
| 7,150,272 | B2 | 12/2006 | Person |
| 7,458,350 | B2 | 12/2008 | Diggs |
| 7,600,498 | B2 | 10/2009 | Diggs |
| 7,617,807 | B2 | 11/2009 | Diggs et al. |
| 7,861,680 | B2 | 1/2011 | Diggs |
| 7,895,992 | B2 | 3/2011 | Diggs et al. |
| 10,087,790 | B2 | 10/2018 | Genise et al. |
| 10,408,094 | B2 | 9/2019 | Van Wingerden et al. |
| 10,774,693 | B2 | 9/2020 | Baltrucki et al. |
| 2005/0000498 | A1 | 1/2005 | Persson |
| 2007/0204826 | A1 | 9/2007 | Diggs et al. |
| 2008/0202455 | A1 | 8/2008 | Diggs |
| 2011/0186008 | A1 | 8/2011 | Zapf |
| 2018/0209309 | A1 | 7/2018 | Van Wingerden et al. |
| 2020/0109648 | A1 | 4/2020 | Baltrucki et al. |
| 2020/0182108 | A1 | 6/2020 | Van Wingerden |
| 2020/0300131 | A1 | 9/2020 | Klampfer et al. |
| 2020/0325803 | A1 | 10/2020 | Patil et al. |

FOREIGN PATENT DOCUMENTS

| | | | |
|---|---|---|---|
| CN | 107771242 | A | 3/2018 |
| CN | 108603420 | A | 9/2018 |
| CN | 110234849 | A | 9/2019 |
| DE | 4200510 | A1 | 7/1993 |
| DE | 102016212480 | A1 | 1/2018 |
| EP | 1712748 | A1 | 10/2006 |
| EP | 1712748 | B1 | 4/2010 |
| EP | 3073072 | A2 | 9/2016 |
| JP | 2009091943 | A | 4/2009 |
| WO | WO 2006090292 | A2 | 8/2006 |
| WO | 2012085394 | A1 | 6/2012 |
| WO | WO 2017091798 | A1 | 6/2017 |
| WO | 2019036272 | A1 | 2/2019 |
| WO | WO 2019092245 | A1 | 5/2019 |
| WO | 2019133658 | A1 | 7/2019 |

OTHER PUBLICATIONS

CN search report received for Chinese Application No. 2021800125753, dated Oct. 19, 2023, 5 pages.

CN OA received for Chinese application No. 202180012575.3 dated Mar. 31, 2023, 10 pages.

CYLINDER DEACTIVATION MECHANISMS FOR PUSHROD VALVE TRAIN SYSTEMS AND ROCKER ARMS

PRIORITY

This application is a U.S. National Phase application under 35 U.S.C. § 371 of International Application No. PCT/EP2021/025043, filed on 5 Feb. 2021, which claims the benefit under 35 U.S.C. § 119 of Indian Application No. 202011005474, filed on 7 Feb. 2020, and of Indian Application No. 202011035869, filed on 20 Aug. 2020.

This is a United States § 371 National Stage Application of PCT/EP2021/025043 filed Feb. 5, 2021 and claims the benefit of Indian provisional application 202011005474 filed Feb. 7, 2020 and claims the benefit of Indian provisional application 202011035869 filed Aug. 20, 2020, all of which are incorporated herein by reference.

FIELD

This application provides alternative actuators for implementing variable valve actuation, such as cylinder deactivation, on rocker arms of pushrod valve train systems.

BACKGROUND

A stamped sheet material rocker arm offers many advantages of tight packaging and light weighting. This alone provides fuel economy benefits and reduces environmental impact. But the compact size also presents challenges for offering variable valve actuation techniques. Techniques such as cylinder deactivation (CDA) are known to further reduce fuel consumption and it is desired to include CDA when using the stamped sheet material rocker arms.

SUMMARY

The methods and devices disclosed herein overcome the above disadvantages and improves the art by way of a valvetrain assembly comprising a deactivatable rocker arm where a pushrod is configured to transfer a valve lift profile through to the valve end of the rocker arm to a valve or valve bridge. A castellation assembly in a carrier and alternative two-piece rocker arm assemblies with rotary or linear actuators are shown for deactivating the transfer of the valve lift profile.

A rocker arm assembly can comprise a first rocker arm comprising a first carrier opening. A second rocker arm can also comprise a second carrier opening. A carrier can be positioned in the first carrier opening and in the second carrier opening. The carrier can seat a first castellation assembly comprising a first gear-toothed crown, a second castellation assembly comprising a second gear-toothed crown, and an actuation gear. The actuation gear can be meshed between the first castellation assembly and the second castellation assembly to simultaneously rotate the first gear-toothed crown and the second gear-toothed crown.

A rocker arm assembly can alternatively comprise a valve side arm comprising a rocker arm plate configured with a latch ledge, a valve end, a pivot location in a carrier opening, a pivot pin bore, and a first spring mount. A deactivating arm can comprise a second spring mount, a split portion flanking the latch ledge, a pivot pin pass-through in the split portion, a latch bore, and a latch pin configured to reciprocate in the latch bore. A pivot pin can connect the pivot pin bore and the pivot pin pass-through. A lost motion spring positioned between the first spring mount and the second spring mount.

A valvetrain assembly can comprise one or more rocker arm assembly. The valvetrain assembly can comprise a pushrod configured to push the deactivating arm and transfer a valve lift profile through the valve side arm to a valve or valve bridge. When the latch pin is engaged with the latch ledge at the start of the valve lift profile transfer, the pushrod pushes the deactivating arm so that the latch pin cannot retract from the engagement with the latch ledge. But, when the latch pin is released from the latch ledge, the pushrod moves without transferring the valve lift profile to the valve side arm.

Additional objects and advantages will be set forth in part in the description which follows, and in part will be obvious from the description, or may be learned by practice of the disclosure.

DETAILED DESCRIPTION

Figure 1:
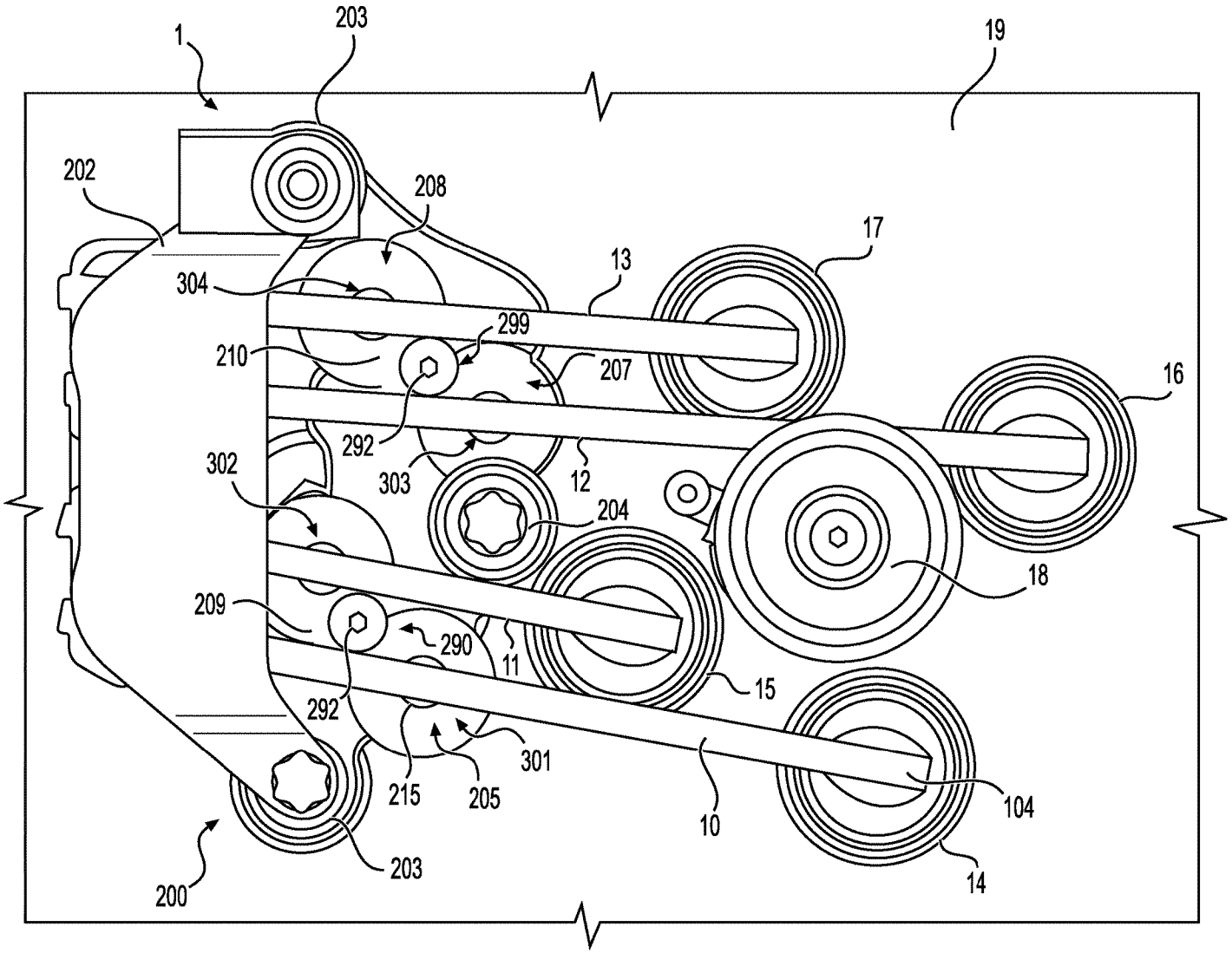
FIG. 1 is a view of a rocker arm assembly fitted with a carrier on an engine block.
Figure 2:
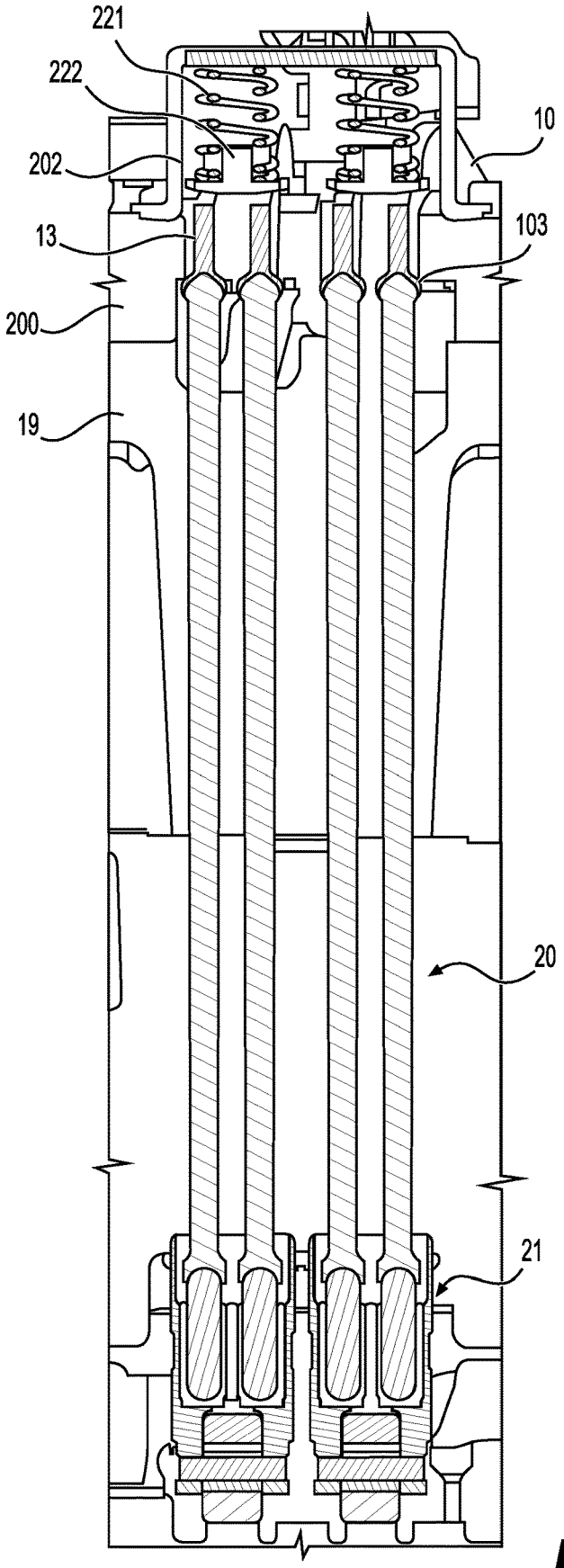
FIG. 2 is a side view of the engine block and rocker arm assembly with additional valvetrain components.
Figure 3:
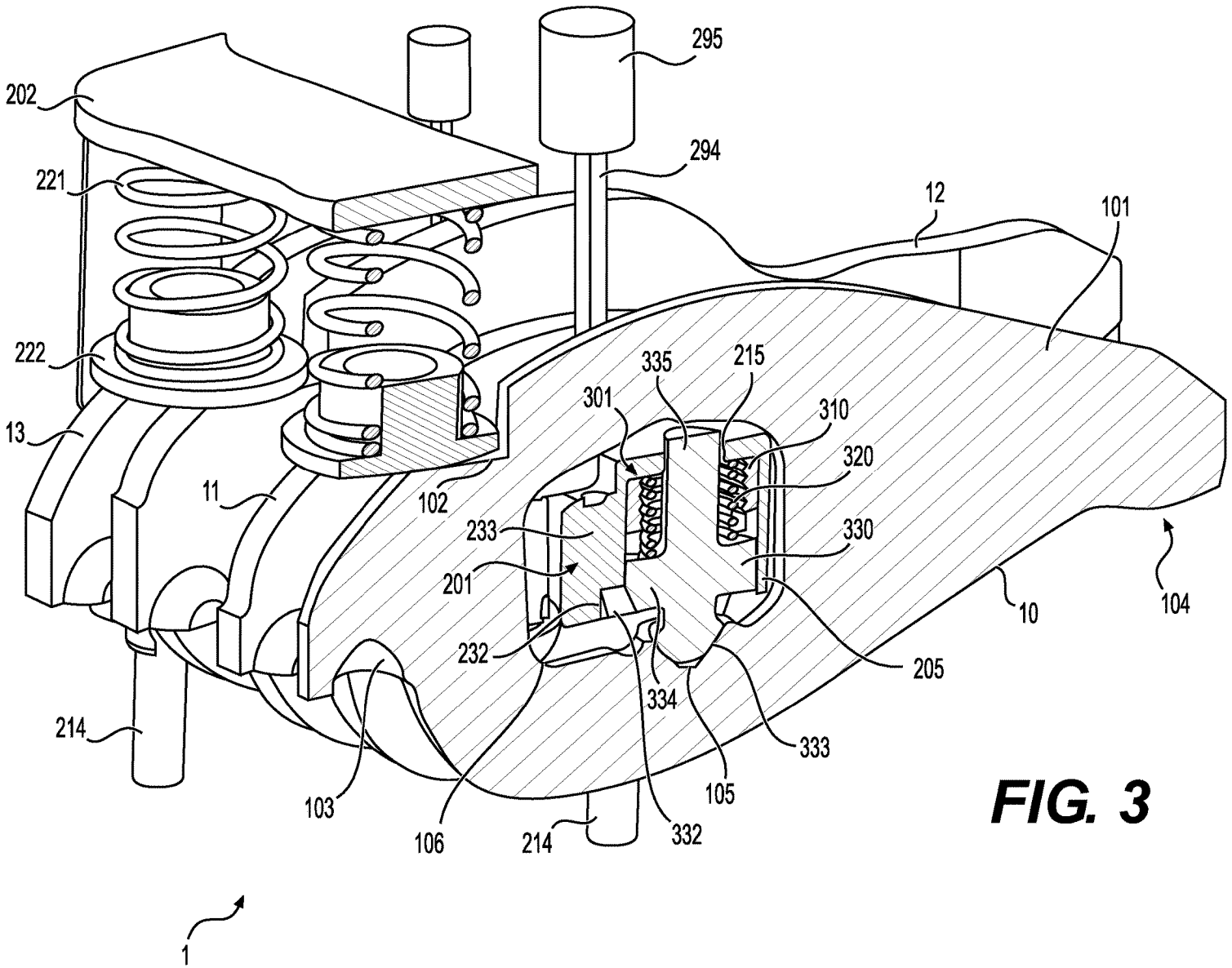
FIG. 3 is a partial section view of the rocker arm assembly.

Reference will now be made in detail to the examples which are illustrated in the accompanying drawings. Wherever possible, the same or like reference numbers will be used throughout the drawings to refer to the same or like parts. Directional references such as "left" and "right" are for ease of reference to the figures.

Cylinder deactivation (CDA) is one of the technologies to be used by Vehicle OEMs to meet the upcoming emission norms. The disclosure details out mechanisms to achieve CDA. Some mechanisms can be used for other variable valve actuation (VVA) techniques, such as engine braking or extended or lift techniques comprising late or early valve closing or opening (LIVC, EEVO, iEGR, etc.).

A first of the mechanisms to achieve CDA, and one that can be configured to implement other VVA techniques, comprises alternative castellation assemblies 301-305 configured in a carrier 201. The configuration with the carrier 201 offers a compact configuration compatible with the stamped sheet rocker arms 10-13. The number and size of actuation mechanisms is minimized by integrating multiple components in the carrier 201. Because of its compact configuration, the carrier 201 can find utility in other rocker arm assemblies.

A rocker arm assembly 1 comprises four rocker arms 10-13, but can comprise pairs of two rocker arms and a carrier of a pair of castellation assemblies 301-305. First rocker arm 10 comprises a first carrier opening 106. The carrier opening can be stamped or cut, among other forming techniques, into a rocker arm plate 101 formed of a sheet material. Peening or other forming techniques can be used to form a pivot location 105 in the carrier opening 106. Likewise, forming techniques can shape the sheet material of the rocker arm plate 101 to comprise a pushrod socket 103 and a valve end 104. A reaction area 102 is formed near the pushrod socket 103. These features can be duplicated on the other rocker arms 11-13, including duplication to a second rocker arm 11 comprising a second carrier opening. Variations in size and shape of the rocker arm, including bends, can permit differences in valve lift profile applied to associated valves 14-17 and can facilitate packaging around the spark plug 18, among other accommodations.

A tower 200 can be mounted to an engine block 19. The engine block can comprise cylinders for the valves 14-17 to selectively open and close for combustion. Push rods 20 and lifters 21 can be cam-actuated with forces transferred to the stamped sheet rocker arms 10-13. Alternatives, such as lash adjusters, tappets, guides, linkages, among others, are compatible with the teachings herein.

Carrier 201 can form a portion of tower 200. Carrier 201 can comprise a carrier body 233 formed with a top plate 2011, mounting areas 203, 204, rocker arm slots 211, castellation bores 205-208, and gear bores 209-210. Pins 335 of the castellation assemblies 301-305 can be seated in the top plate 2011, as by being guided in pin bores 215. Mounting areas 203, 204 can secure the carrier 201 to the engine block 19, along with stays 214. A reaction bar 202 can be secured to the carrier 201 at mounting areas 203. Reaction bar 202 can position reaction springs 221 and spring caps 222 against respective reaction areas 102 so that the rocker arms 10-13 are guided during their motions. Rocker arm slots 211 can guide or flank the rocker arms 10-13.

Carrier 201 is positioned in the first carrier opening 106 and in the corresponding second carrier opening of second rocker arm 11. Carrier 201 can seat a first castellation assembly and second castellation assembly 301-305 comprising a respective first gear-toothed crown and a second gear-toothed crown. Variations in the first castellation assembly and the second castellation assembly 301-305 will be discussed more below.

Carrier 201 comprises an actuation gear 290, 299 meshed between the first castellation assembly and the second castellation assembly to simultaneously rotate the first gear-toothed crown and the second gear-toothed crown. Actuation gear 290, 299 can comprise, for example, a gear body 291, gear teeth 293 extending form the gear body 291, and a coupling area 292. A rotary actuator 295 can be coupled to rotate the actuation gear 290, 299 by a variety of mechanisms. A rod 294 can be pressed into the coupling area 292. A mating hex or other keyed configuration can prevent slipping and facilitate transfer from the rotary actuator 295 and the actuation gear 290, 299. Thus, a small and simple package can be maintained and fitted between the rocker arms 10-13. The layout enables a single actuation gear 290, 299 to act on two castellation assemblies thereby keeping low the number of rotary actuators 295.

Figure 4A:
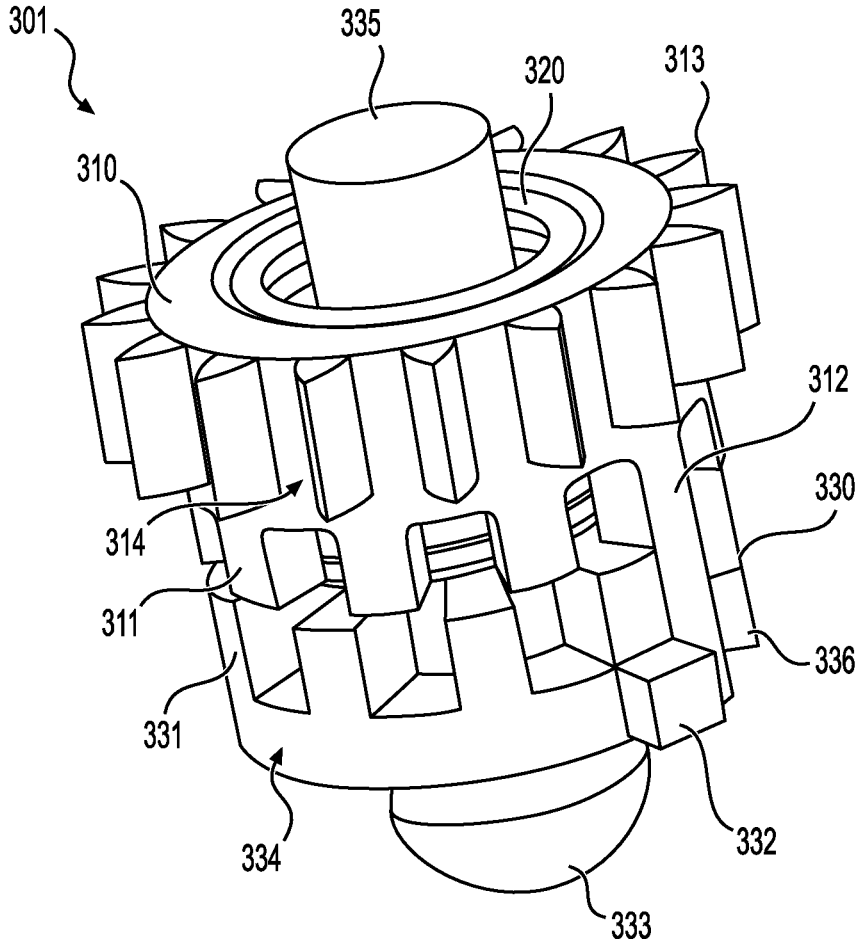
FIGS. 4A & 4B show alternative castellation assemblies.
Figure 4B:
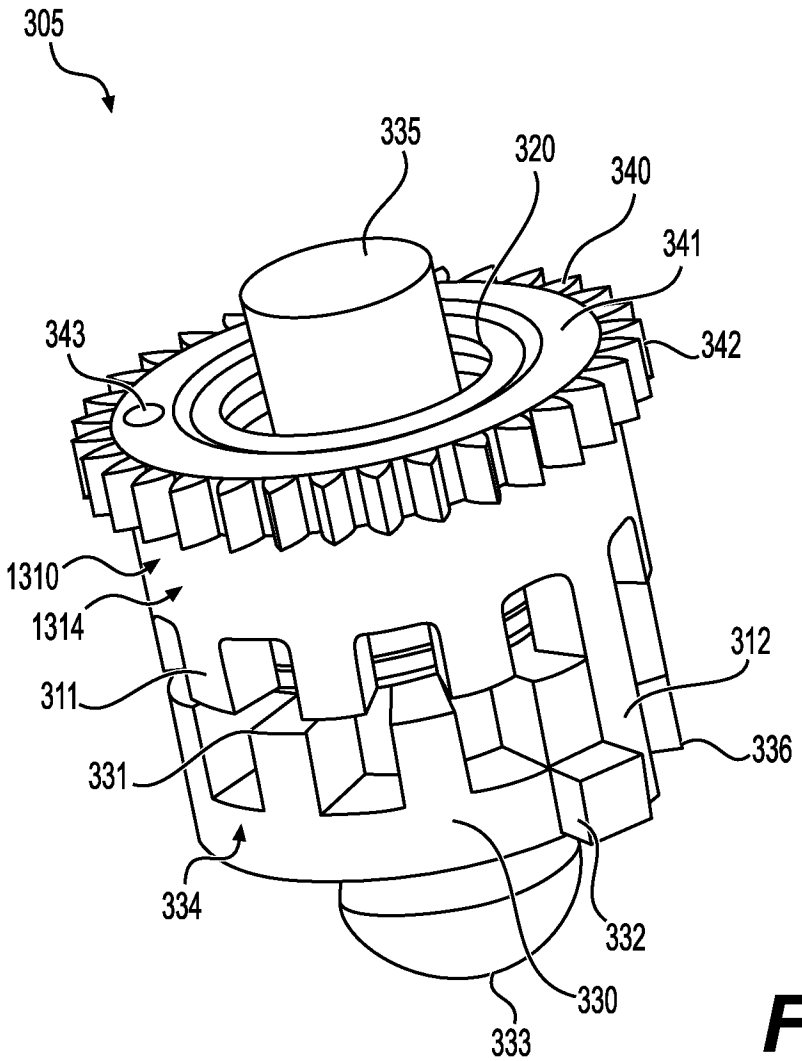
Figure 4C:
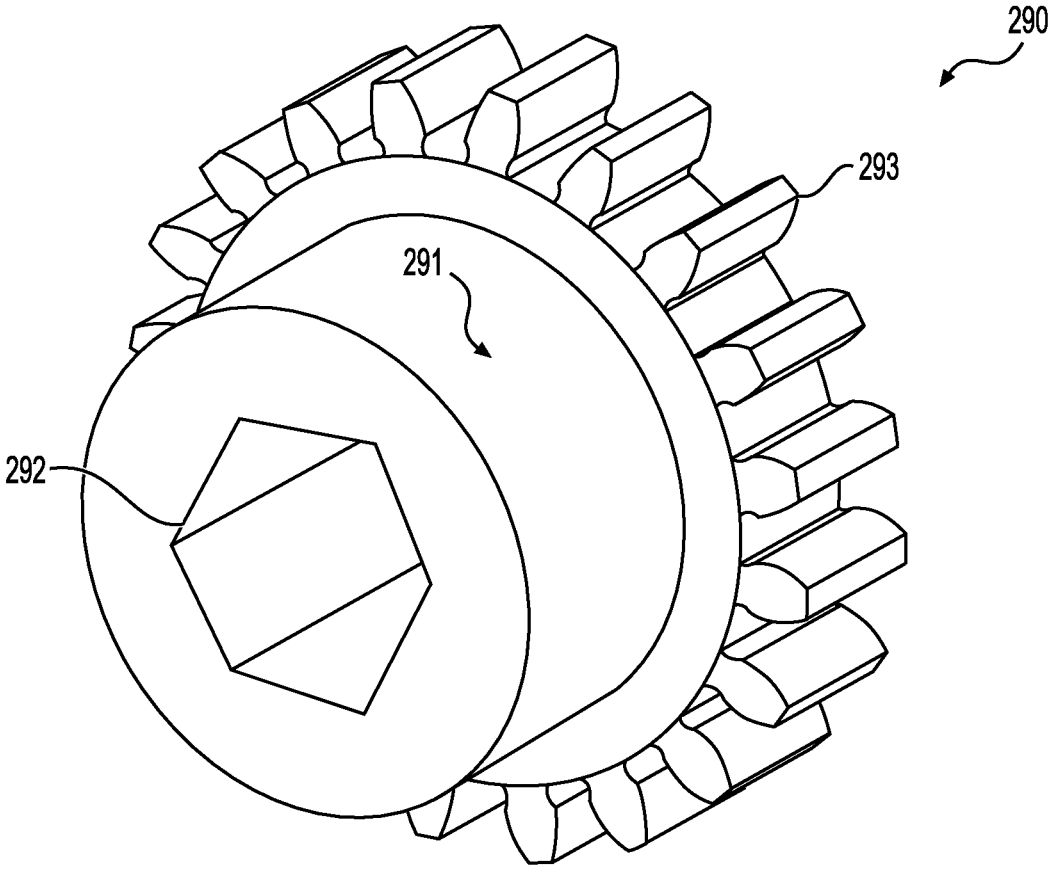
FIG. 4C shown an example of an actuation gear.

As compared to other actuation arrangements for castellation assemblies, and while having a larger footprint than a single-toothed linkage or single-pivot linkage, the disclosed actuation gear 290, 299 can comprise continuously circumferentially distributed gear teeth (illustrated in FIG. 4C), or sets of a plurality of continuously circumferentially distributed gear teeth (gaps can occur between sets of successive gear teeth). Gear teeth 293, can comprise, as an example, an involute profile. Having multiple successive gear teeth can accommodate tooth wear and finer control over castellation assembly movement. If a tooth slips or wears, a next tooth on the actuation gear 290, 299, can provide actuation control. Successive teeth also permits finer control because side-by-side teeth can hand-off actuation control to a next side-by-side pairing of gear teeth, and that hand-off gap can be made small or large as the degree of actuation can be adjusted. If a large rotation is desired, the successive gear teeth more reliably couple than a single point of contact linkage.

Each rocker arm 10-13 is illustrated to comprise a corresponding castellation assembly 301-304. An alternative castellation assembly 305 can be substituted in each rocker arm. The castellation assemblies 301-305 are configured in the respective pivot locations 105 in the respective carrier openings 106. When using, as an example, a pair of rocker arms 10, 11 to actuate a pair of intake or exhaust valves 14, 15, the first castellation assembly 301 can comprise a first lower crown 330 in a gothic with the rocker arm. Lower crown 330 can comprise a pivot 333 configured press on the first pivot location 105 when the first gear-toothed crown (upper crown) 310, 1310 is selectively aligned to transfer force. Pivot 333 can be a knurl, ball, semi-sphere or other shape that facilitates the transfer or lost motion of force to pivot location 105. Pivot location can be a cup, detent, or other shape that can withstand the force transfer through the respective rocker arm 10-13.

Pivot 333 can be formed to extend from a base 334 of a lower crown 330. Base 334 has lower castellation teeth 331 extending upward therefrom. Base 334 can also comprise features such as a travel stop 336, which can be a groove or slot. A pin 335 can extend up from the base 334. Pin 335 can seat in the pin bore 215 of carrier 201 and thereby maintain a position relative to the carrier 201. An anti-rotation tooth 332 also called a positioning tooth can also be formed to extend from the base 334 into an anti-rotation slot 232 in carrier body 233 in a keyed manner. Lower crown 330 can be keyed to the carrier body 233 to lock lower crown 330 from rotating in the carrier 201.

Castellation assembly 301-305 can further comprise an inner spring 320 configured in the carrier 201 to push the lower crown 330 away from the gear-toothed upper crown 310, 1310. An inner spring 320 can seat against base 334 and can be guided by pin 335. Inner spring 320 can seat against a blind bore portion of castellation bore 205. The seated inner spring 320 can bias the lower crown 330 away from the upper crown 310, 1310 so that when there is no force transfer through the rocker arm, the upper crown 310, 1310 can move relative to the lower crown 330.

In a first alternative of the gear-toothed upper crown, integrally formed gear teeth 313 are on upper crown body 314. Upper crown 310 comprises an upper crown body 314 from which upper castellation teeth 311 extend downward. Also, a travel limit tooth 312 extends down into the slot or groove forming travel stop 336. External gear teeth 313 are integrally formed with the upper crown body 314. These gear teeth 313 on the upper crown body 314 can mesh with the gear teeth 293 of the actuation gear 290, 299. The profile of the gear teeth 313 can be selected to control the fine motion of the upper crown 310 relative to the lower crown 330. In one position, the upper castellation teeth 311 can align with the lower castellation teeth 331. Then, force transfers from the pushrods, to the pushrod socket 103 and the rocker arm 10 pivots at the pivot location to transfer a lift profile to the valve end 104. However, if the actuation gear 290, 299 rotates the upper crown 310 so that the upper castellation teeth 331 align with pockets between the lower castellation teeth 331, and the lower castellation teeth 331 align with pockets between the upper castellation teeth 311, then when the force transfers up from the pushrods to the pushrod socket 103, the upper crown 310 collapses into the lower crown 330. This can enable cylinder deactivation (CDA) where the rocker arm fails to rotate at the valve end 104 leaving the valves 14, 15 closed. Or, the valve end 104 can have a different lift profile than before because the force transfers after the collapse of the upper crown 310 into the lower crown 330. This force transfer is a matter of design choice and castellation tooth length.

In the alternative castellation assembly 305, the alternative gear-toothed crown comprises a gear wheel 340 secured to an upper crown body 1314. Many aspects remain the same as the castellation assemblies 301-304. But, the upper body 1314 is smooth for rotation in the castellation bore 205-208. A gear wheel 340 is secured by a screw or stake 343 to the upper body 1314 and gear wheel body 341. Gear teeth 342 on gear wheel 340 can mesh with actuation gear 290, 299 as above.

The disclosed castellation devices permit the unique packaging of the stamped sheet rocker arms to switch between drive mode and deactivated mode. In the drive mode, the castellation is in a solid state state, where the upper castellation teeth 311 of upper crown 310, 1310 are aligned with the lower castellation teeth 331 in the lower crown 330. During cam lift, the castellation assemblies 301-305 act like a rigid pivot, and the valve lift of valves 14-17 is achieved. In the deactivated mode, which can comprise a cylinder deactivation or "CDA Mode," the stepper motor of the rotary actuator 295 rotates the upper crown 310, 1310 through a gear arrangement. The upper castellation teeth 311 of the upper crown 310, 1310 are then aligned with the valleys in the lower crown 330. The cam lift is taken up by as lost motion by the inner spring 320 in the castellation assembly 301-305. There is zero valve lift of valves 14-17.

A single carrier 201, which can be part of a larger tower 200, can be configured to house the castellation assemblies 301-305 and can be configured to house the rocker assemblies and the motor assembly of the rotary actuator 295. Actuation being electro-mechanical, the castellation assemblies 301-305 can be actuated even at very low engine RPMs, which would not be possible with hydraulic actuation. Also, the relatively simple electro-mechanical actuation can have a faster response time than hydraulic actuation.

Alternatives can be accommodated, as similar rocker arm assembly architectures (2-intake valves; 2-exhaust valves) can be used. Independent valve lash control can be maintained with lash devices in the lifters/tappets or at other interfaces with the pushrods.

Packaging of the motor assembly is challenging in the current available cylinder head space. But, with the carrier 201, up to four castellation assemblies 301-305 and corresponding electric motor (rotary actuator 295) can be packaged compactly. Loading can occur on the castellation assemblies 301-305 during drive mode, but the carrier also alleviates the loading. Side loading at the inner spring 320 or reaction springs 221 (also called a Lost Motion Spring ("LMS")) and fulcrum have design considerations incorporated. Packaging and assembly of LMS reaction spring 221 is achieved with the spring caps 222 and reaction bar 202. Higher force is needed by the LMS reaction spring 221 to resist pump up and contact loss, if it all experienced. Those forces are placed within the castellation assemblies 301-305. The carrier 201 pin bore 215 can guide the pin 335 of the lower castellation 331 and reduce the side loading while the top plate 2011 can distribute the force needed to resist pump up and contact loss.

In another alternative, rocker arm assemblies 2, 3 can be electrically actuated in a valvetrain to switch between drive mode and deactivated mode. The unique packaging issues of the stamped sheet or plate type rocker arms can be accommodated with offering variable valve actuation techniques. A deactivatable rocker arm 1110-1115 is mounted in a type V (pushrod) engine. Aspects for the engine block 19 and pushrod 20 actuation is shown in the FIGS. 6-10C and incorporated from above. The pushrods 20 are configured to transfer a valve lift profile through to the valve end 1104 to a valve 14-17 or valve bridge 20, 23. In lieu of the above castellation assemblies 301-305 in a carrier 201, alternative two-piece rocker arms 1110-1115 can be arranged with rotary or linear actuators 6100, 90 for deactivating the transfer of the valve lift profile.

The alternative rocker arm assemblies 2, 3 provide several benefits. For example, when the linear actuator assembly 90 is de-energized, latch pin 5100 is engaged and the cam lift from the pushrods 20 is converted to valve lift of valves 14-17 through the latch pin 5100. When the linear actuator assembly 90 is energized, the pin 94 is raised. The pin end 97 can maintain contact or clear the latch end portion 5104, and the latch pin 5100 is disengaged from the latch ledge 1108 and the cam lift from the pushrods 20 is taken up by deactivating arm 2100 giving zero valve lift to valves 14-17.

A single pivot carrier 1201, 1202, which can be part of tower 1200, can mount within the carrier opening 1106 of the deactivating rocker arm assemblies 2, 3 and the tower or pivot carrier 1201 can guide the linear actuators 90. The pivot carrier 1201, 1202 can provide a pivot 1203 for each rocker arm 1110-1115 in the rocker arm assembly 2, 3. This is a departure from installing individual tower portions with a pivot for each rocker arm, though the individual tower portion arrangement can be compatible with the teachings herein. Linear or rotary actuator assembly 90, 6100 can be provided per each cylinder for cylinder-by-cylinder deactivation, or pairs or banks of rocker arms can be actuated by a common linear or rotary actuator assembly for techniques such as half-engine CDA or 2-cylinder CDA. The actuation being electro-mechanical, it can be actuated even at very low engine RPMs, which is not possible with hydraulic actuation. So, relatively simple electro-mechanical actuation can be had with fast response time. Rocker arm assemblies can be used in architectures with 2-intake valve & 2-exhaust valves, among other architectures where more or fewer valves are actuated. Independent valve lash control can also be maintained at the pushrod.

Figure 6:
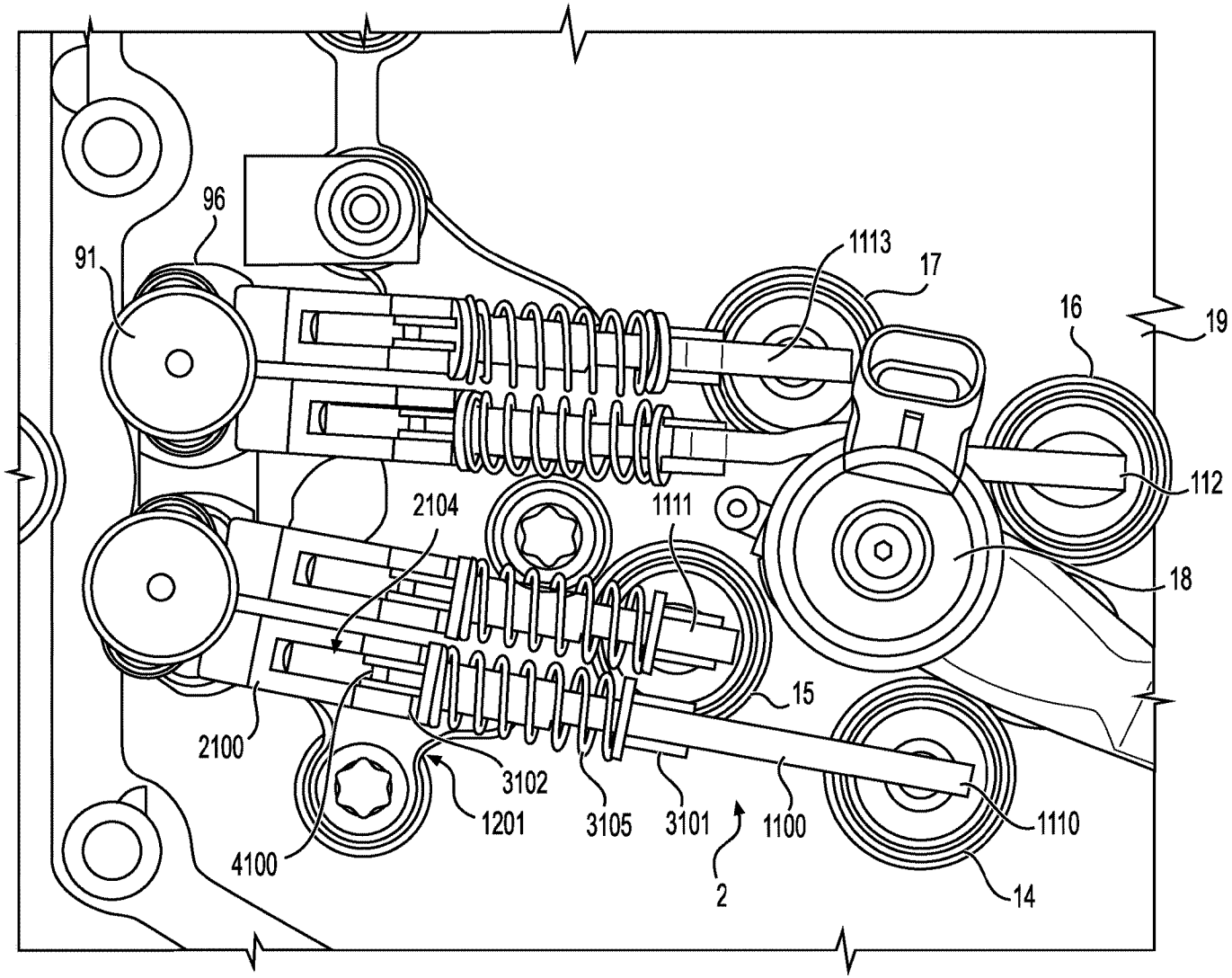
FIG. 6 is a view of an alternative rocker arm assembly fitted with linear actuators on an engine block.
Figure 7:
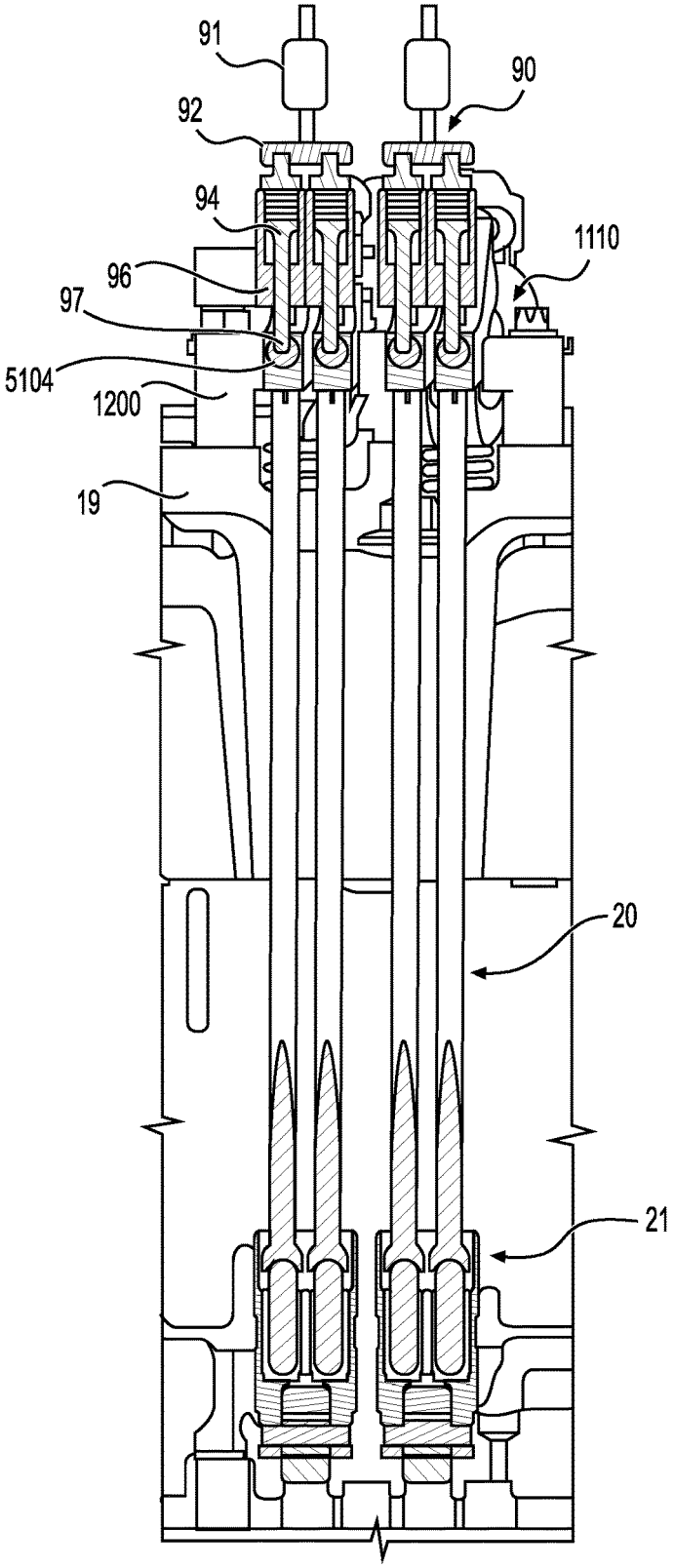
FIG. 7 is a side view of the alternative rocker arm assembly with additional valvetrain components.
Figure 8:
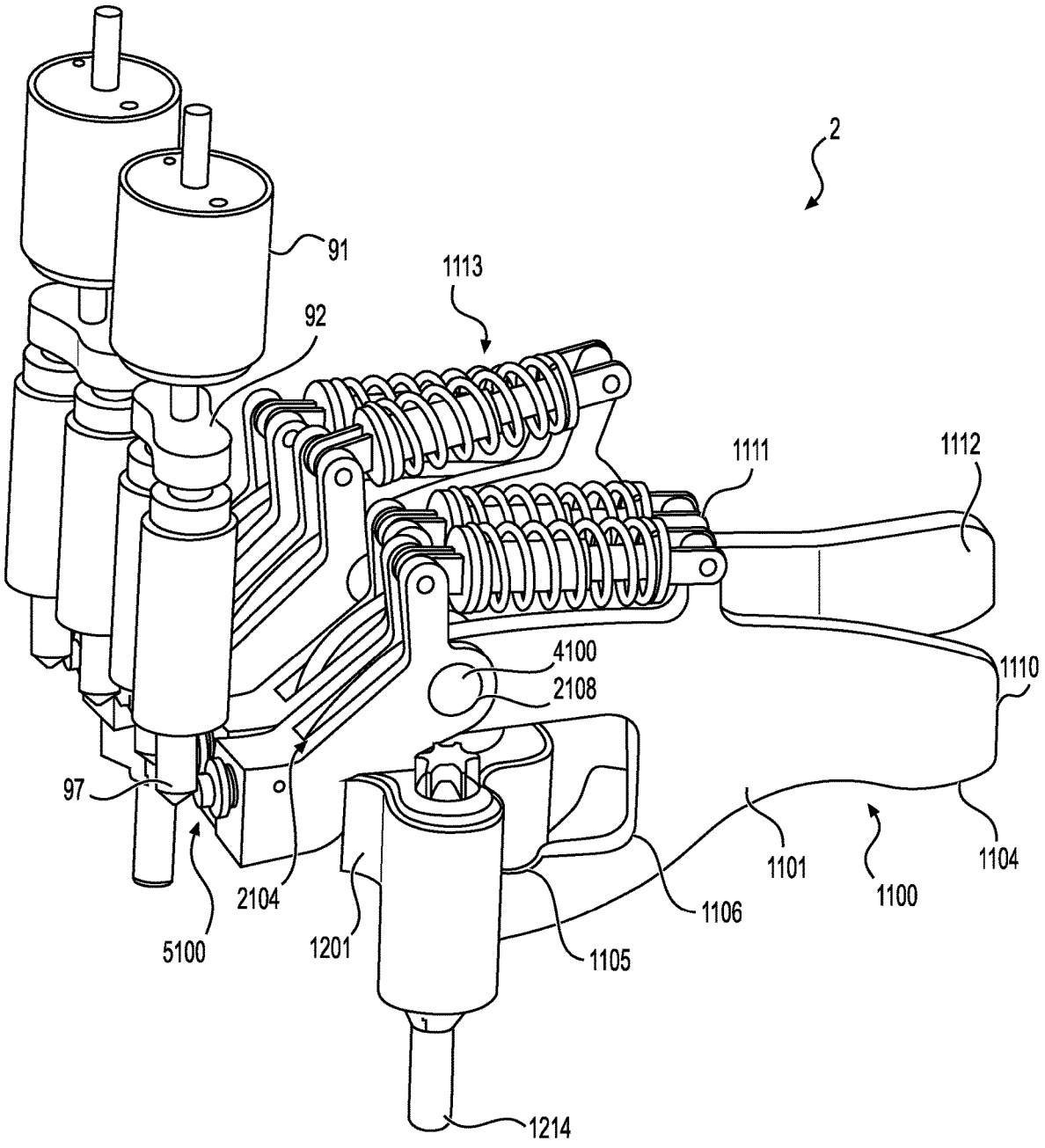
FIG. 8 is a perspective view of the alternative rocker arm assembly.
Figure 9A:
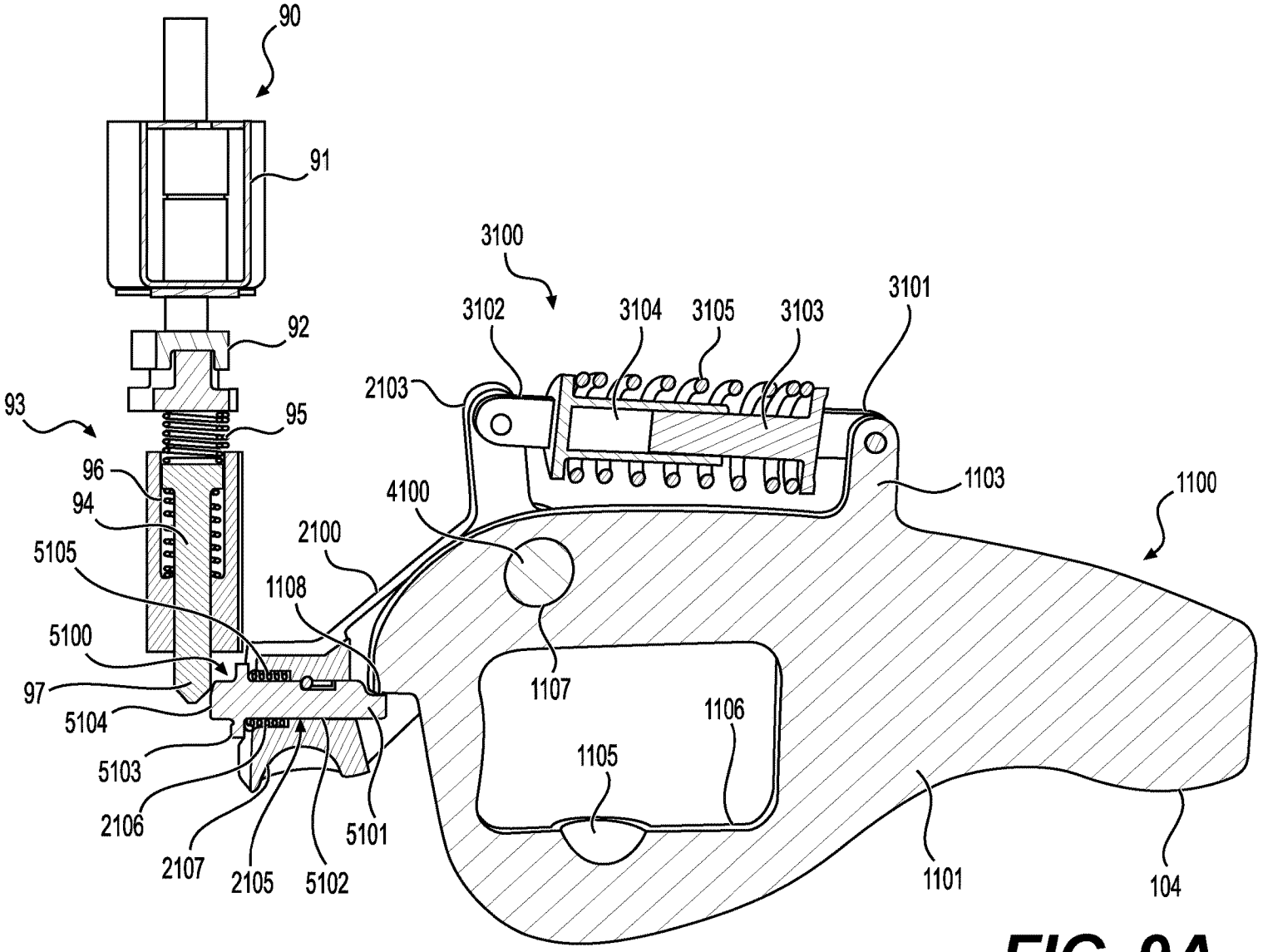
FIGS. 9A & 9B are a cross-section views of one of the alternative rocker arms in an engaged state and a disengaged state, respectively.
Figure 9B:
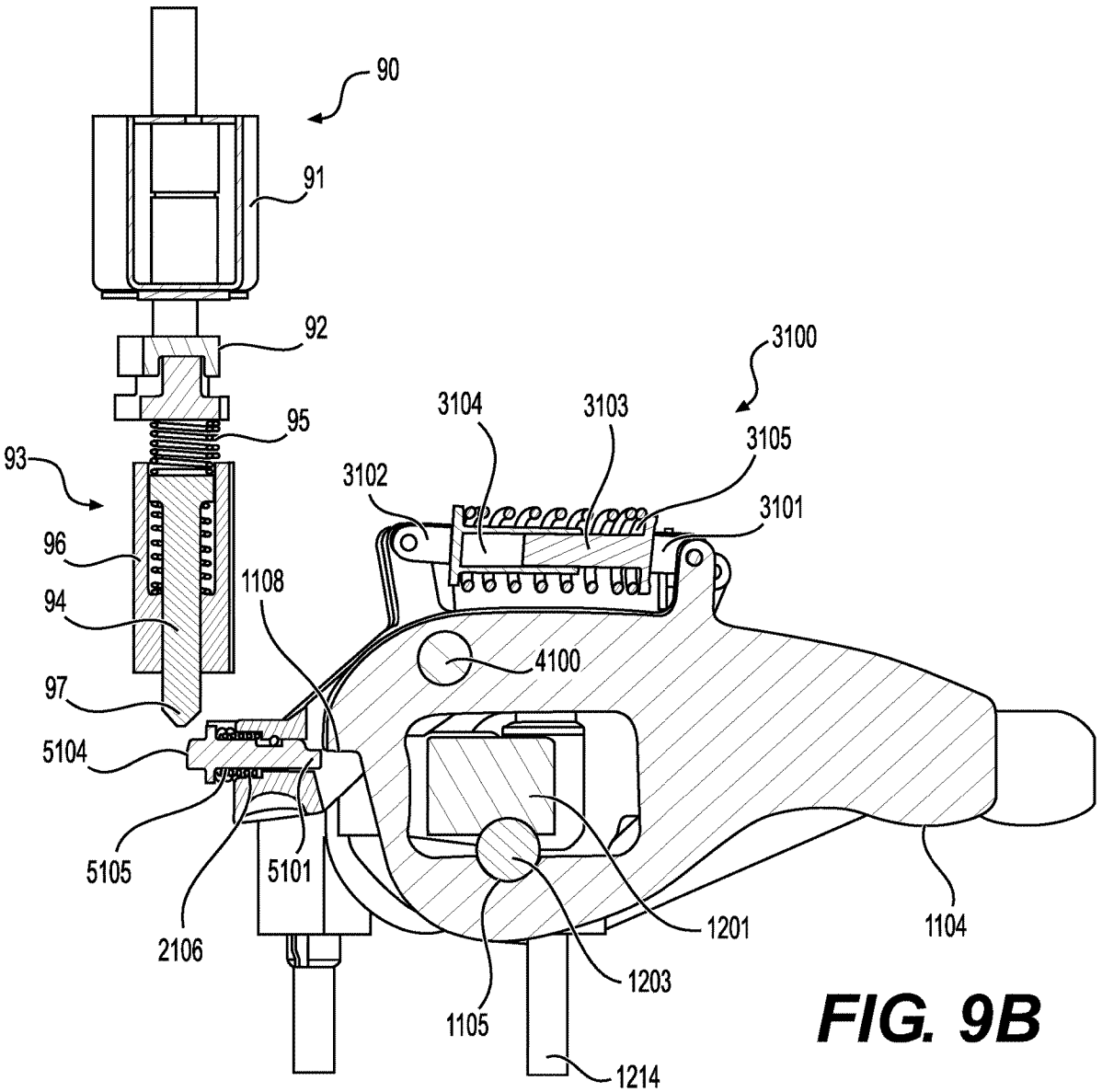
Figure 10A:
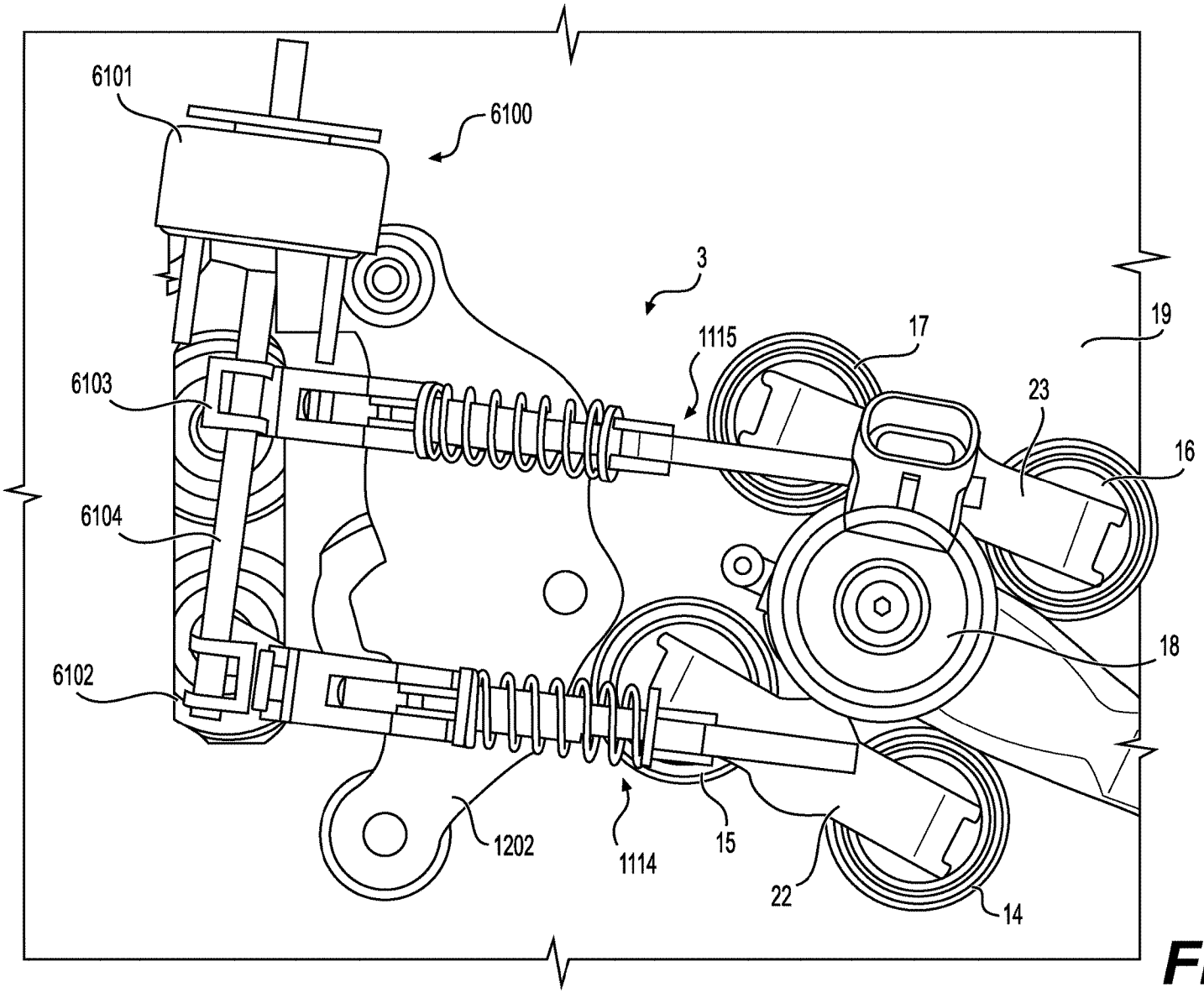
FIG. 10A is a view of another alternative rocker arm assembly fitted with a rotary actuator on an engine block.
Figure 10B:
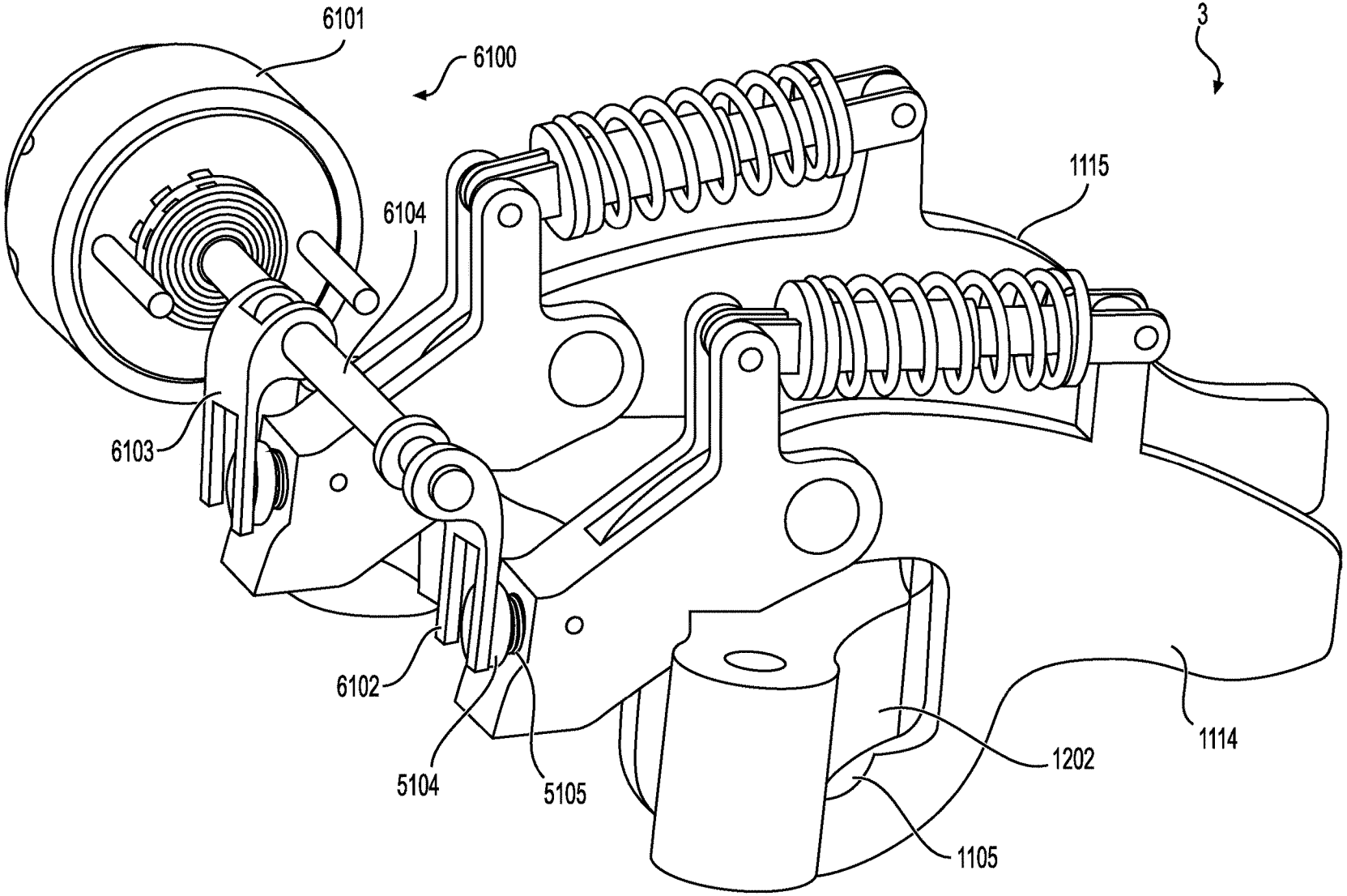
FIGS. 10B & 10C are views of the alternative rocker arm assembly in an engaged state and a disengaged state, respectively.
Figure 10C:
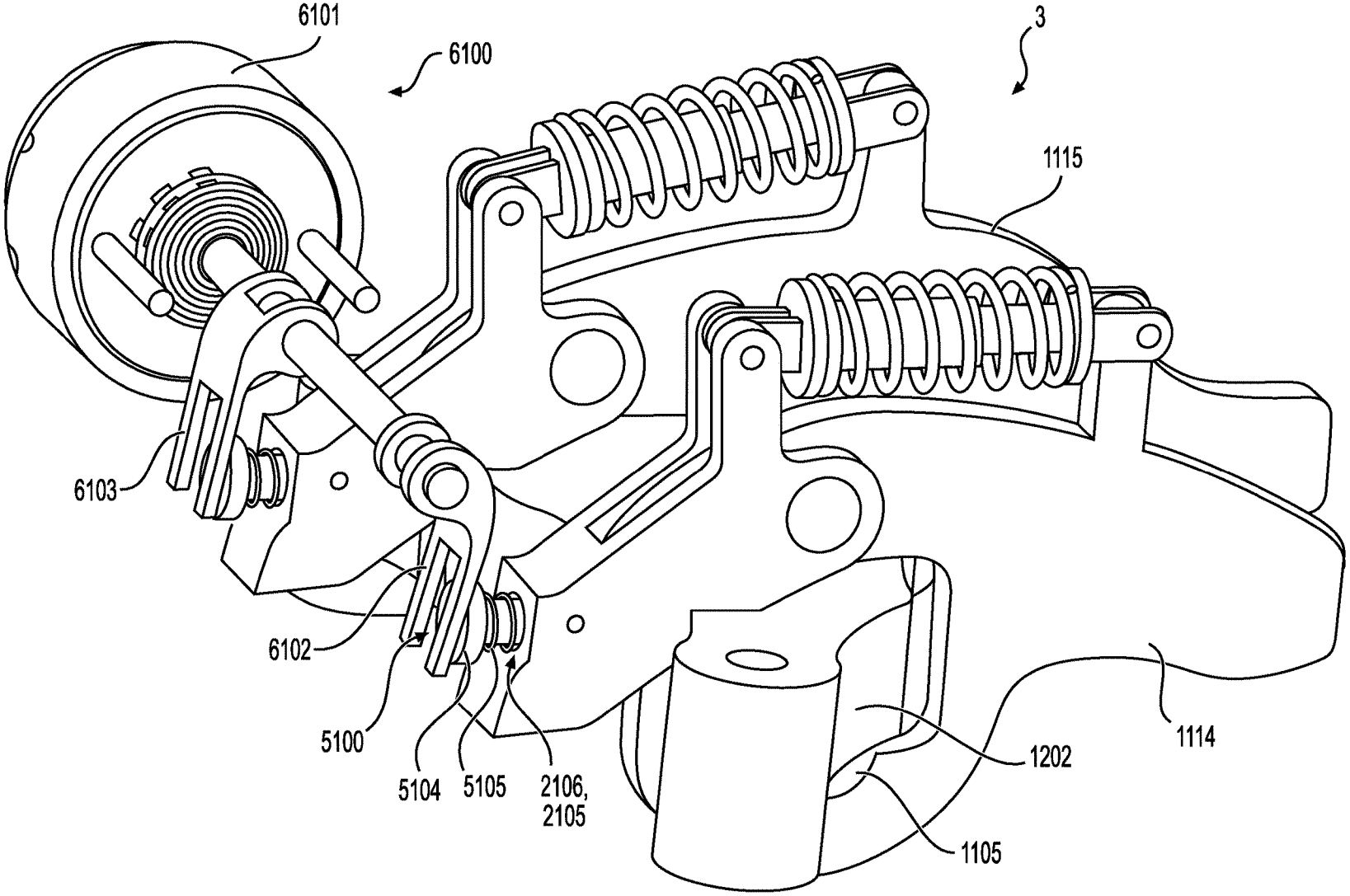

Turning to FIGS. 6-8, two linear actuator assemblies 90 are used per set of intake and exhaust rocker arms 1110-1113. So, one of the linear actuator assemblies actuates the intake rocker arms 1110-1111 and the other of the linear actuator assemblies 90 actuates the exhaust rocker arms 1112-1113. It is possible to arrange the rocker arms as shown in FIGS. 10A-10C, so that only two rocker arms 1114, 1115 are used with valve bridges 22, 23 to actuate four valves 14-17. So, the description for linear actuator assembly 90 can be with a single pin 94 for a single latch pin 5100 or for two pins 94 for side-by-side latch pins 5100 as drawn.

The linear actuator assembly 90 can comprise an actuator 91 such as a solenoid with a movable armature 92. The armature 92 can comprise a linkage 93 for transferring actuation forces from the armature 92 to one or more pin 94. Pin or pins 94 can be guided in a mount 96 so that a pin end 97 slides against latch end portion 5104. Pin end can be tapered or otherwise shaped to facilitate sliding motion and transfer of force to the latch pin 5100. Actuator spring 95 can be mounted in the mount 96 and against the pin 94 to bias the pin 94 in an engaged or disengaged state, as a matter of design choice. That is, the actuator 91 can raise or lower the pin 94 from the position in which it is biased based on whether the starting position of the pin 94 is selected as facilitating a force transfer in an engaged state or as facilitating deactivation in a disengaged state. Packaging of the linear actuator assembly 90 is challenging in the current available cylinder head space, so the ability to actuate more than one rocker arm with a single linear actuator assembly is desired.

Lost motion spring (LMS) spring packaging can be challenging, also, since rocker arms are really close to each other. So, it is beneficial that the valve side arm 1100 and deactivating arm 2100 are arranged ash shown to package lost motion spring 3105 in a lost motion spring assembly 3100.

So, rocker arm assembly 2 can comprise a valve side arm 1100 comprising a rocker arm plate 1101 configured with a latch ledge 1108, a valve end 1104, a pivot location 1105 in a carrier opening 1106, a pivot pin bore 1107, and a first spring mount 1103. A cut, stamped, or pressed sheet material can again be used with peening or other forming of pivot location 1105. Such lightweighting yields a low cost and compact rocker arm compared to alternative designs not made of sheet material.

Figure 5:
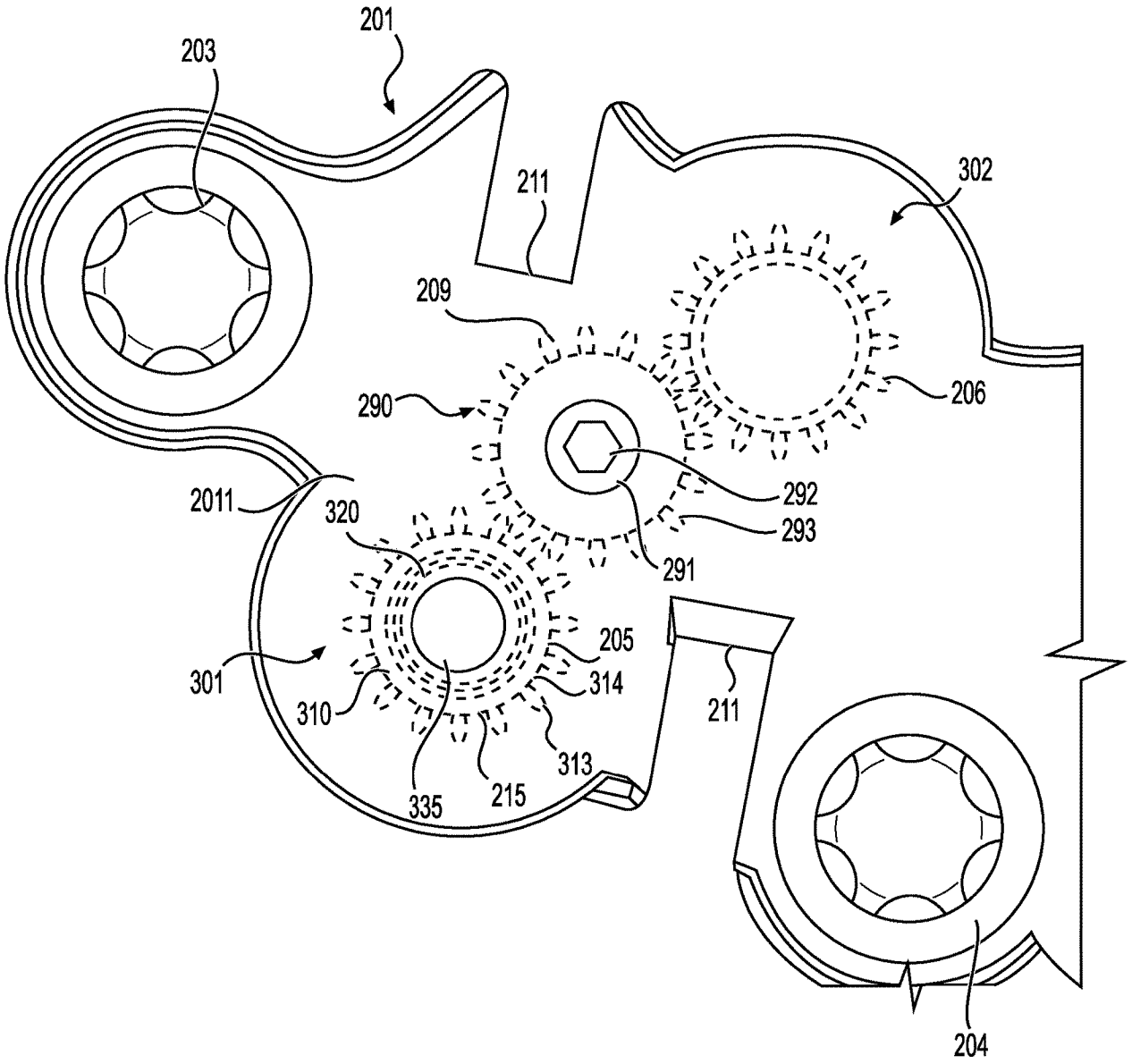
FIG. 5 shows a partial view of the carrier.

Rocker arm assembly 2 can also comprise a deactivating arm 2100 comprising a second spring mount 2103, a split portion 2104 flanking the latch ledge 1108, a pivot pin pass-through 2108 in the split portion 2104, a latch bore 2105, and a latch pin 5100 configured to reciprocate in the latch bore 2105. Additional features can comprise a latch spring 5105 in a spring cup 2106, the spring cup 2106 being within the latch bore 2105. The latch spring 5105 can be configured to bias the latch 5100 out of engagement with the latch ledge 1108 so that the latch spring forces oppose the pushing from the pin 94. Latch pin 5100 can comprise a spring seat 5103 in the form of a lip, rim, or other spring retainer to position the latch spring 5105. Latch pin 5100 can also comprise latch body 5102 terminating with a nose 5101, which can be stepped, tapered, or otherwise shaped to facilitate easy re-positioning of the latch ledge 1108 in the engaged state after being in the disengaged state. A push rod socket 2107 can be formed under the latch bore 2105 to receive forces from the pushrod 20. Deactivating arm 2100 can also be formed of a stamped, cut, or pressed sheet material. The sheet material can be cut to shape and then bent and peened, among other techniques, to form the latch bore 2105, spring cup 2106, and push rod socket 2107. Deactivating arm 2100 can also be cast or otherwise formed. Deactivating arm 2100 can be streamlined and lightweighted and generally of a shallow U-shape. With the lack of a central rocker shaft, there is no need to anchor the deactivating arm 2100 to rotate around a rocker shaft. The deactivating arm 2100 can remain of compact size in its relationship with pivot carrier 1201. Pivot carrier 1201 could comprise a slot or other guide, similar to FIG. 5, for one or both of valve side arm 1100 and deactivating arm 2100. But, excess material in the rocker arm assembly 2 can be avoided.

A pivot pin 4100 or other fastener can connect the pivot pin bore 1107 and the pivot pin pass-through 2108. Pivot pin bore 1107, and thus pivot pin 4100 can be over the carrier opening 1106. The pivot pin bore 1107, and thus pivot pin 4100 can also be over the pivot location 1105. Being over the pivot location 1105 or carrier opening 1106 helps to balance inertia and transfer forces across the rocker arm assembly 2. It is possible that, as the rocker arm 1110-1115 "rocks" during valve lift, that the pivot pin 4100 transfers from being over the pivot location 1105 to being over the carrier opening 1106.

Now, further regarding balance, it is possible to put the weight of a lost motion spring assembly 3100 over the carrier opening 1106 and thus the pivot carrier 1201. This alleviates some resistance to motion of the push rod 20. A lost motion spring 3105 can be positioned between the first spring mount 1103 and the second spring mount 2103. There is some flexibility in the position of the lost motion spring 3105, as seen in FIG. 8, the lost motion spring 3105 can angle around other features in the engine compartment, much like how the rocker arms can themselves have bends or length differences, as seen in FIG. 6.

A first spring guide 3101 can be configured to telescope in a second spring guide 3102 when the lost motion spring 3105 is compressed. Stakes, rivets or other fasteners can secure the first spring guide 3101 to the first spring mount 1103. Likewise, the second spring guide 3102 can be secured to the second spring mount 2103. The stamped and compact design of the first spring mount 1103, being integral with the rocker arm plate 1101, and potential like plate-like formation of second spring mount 2103, minimizes bulk and weight. Spring retaining rims, lips or other features can be included to ensure spring force and position is maintained. Likewise, a plunger 3103 and hollow shaft 3104 arrangement can provide a spring guide for lost motion spring 3105, the guide being collapsible and telescoping.

Linear actuator assembly 90 and rotary actuator assembly are configured to selectively press the latch pin 5100 into engagement with the latch ledge 1108. When the pushrod 20 applies a lift profile to the rocker arm 1110-1115, and the latch pin is in the engaged state, the force transferring through the rocker arm holds the latch pin 100 in place against the latch ledge 1108. So, even though the rocker arm 1110-1115 could move away from the pin 94 or linkage 6102, 6103 during valve lift, the latch pin 5100 cannot slide out from the latch ledge 1108 until the rocker arm 1110-1115 returns to base circle (a non-lift position). So, base circle of the cam actuating the push rod 20 is the time when the pin 94 or linkage 6102, 6103 is moved to release the latch pin 5100 from the latch ledge 1108. If a transfer of force is occurring, latch pin 5100 cannot be released from the latch ledge 1108 when the latch spring 5105 pushes on the spring seat 5103 and the spring cup 2106. Only at base circle can the latch spring 5105 bias the latch nose 5101 out from under the latch ledge 1108. So, it can be said that the linear actuator assembly 90 is configured to switch between an engaged state and a disengaged state, wherein the linear actuator assembly 90 is configured to press the latch pin 5100 into engagement with the latch ledge 1108 in the engaged state, and wherein the linear actuator assembly 90 is configured to release the latch pin 5100 from engagement with the latch ledge 1108 in the disengaged state.

As an alternative to the linear actuator assembly 90, a rotary actuator assembly 6100 can be configured to selectively press the latch pin 5100 into engagement with the latch ledge 1108. Many aspects of the rocker arms 1114, 1115 remain the same as the rocker arms 1110-1113, with the biggest difference being the layout in light of the valve bridges 22, 23. The rotary actuator assembly 6100 has a different space constraint and footprint than the linear actuator assembly 90. But, the rotary actuator assembly 6100 has a compact design that is light and reliable. The rotary actuator 6101 can be an electric motor, solenoid rotor, or other powered device that has similar advantages for start up over hydraulic actuation systems. An armature or other linkage can extend from the rotary actuator 6101 to a rotatable rail 6104. The rail 6104 can comprise linkages 6102, 6103 distributed thereon for selectively pressing or releasing the latch pins 5100 in response to rotation of the rail 6104. Linkages 6102, 6103 can be forked prongs or springs or other movable mechanisms.

The rotary actuator assembly 6100 can likewise be configured to switch between an engaged state and a disengaged state, wherein the rotary actuator assembly 6100 is configured to press the latch pin 5100 into engagement with the latch ledge 1108 in the engaged state, and wherein the rotary actuator assembly 6100 is configured to release the latch pin 5100 from engagement with the latch ledge 1108 in the disengaged state.

A valvetrain assembly can comprise the rocker arm assembly 2, 3. A pushrod 20 can be configured to push the deactivating arm 2100 and transfer a valve lift profile through to the valve side arm 1100 to a valve 14-17 or to a valve bridge 22, 23. When the latch pin 5100 is engaged with the latch ledge 1108 at the start of the valve lift profile transfer, the pushrod 20 pushes the deactivating arm 2100 so that the latch pin 5100 cannot retract from the engagement with the latch ledge 1108. But, when the latch pin 5100 is released from the latch ledge 1108, the pushrod 20 moves without transferring the valve lift profile to the valve side arm 1100. Latch pin 5100 is released from the latch ledge 1108 when the latch spring 5105 can bias the spring seat 5103 and spring cup 2106 apart.

Other implementations will be apparent to those skilled in the art from consideration of the specification and practice of the examples disclosed herein.

What is claimed is:

1. A rocker arm assembly, comprising:

a first rocker arm comprising a first carrier opening;

a second rocker arm comprising a second carrier opening;

a carrier positioned in the first carrier opening and in the second carrier opening, the carrier seating:

a first castellation assembly comprising a first gear-toothed crown;

a second castellation assembly comprising a second gear-toothed crown; and an actuation gear meshed between the first castellation assembly and the second castellation assembly to simultaneously rotate the first gear-toothed crown and the second gear-toothed crown.

2. The rocker arm assembly of claim 1, wherein:

the first rocker arm comprises a first pivot location in the first carrier opening;

the second rocker arm comprising a second pivot location in the second carrier opening;

the first castellation assembly comprises a first lower crown comprising a pivot configured press on the first pivot location when the first gear-toothed crown is selectively aligned to transfer force; and the second castellation assembly comprises a second lower crown comprising a pivot configured to press on the second pivot location when the second gear-toothed crown is selectively aligned to transfer force.

3. The rocker arm assembly of claim 2, wherein the first castellation assembly further comprises an inner spring configured in the carrier to push the first lower crown away from the first gear-toothed crown.

4. The rocker arm assembly of claim 1, wherein the first gear-toothed crown comprises one of a gear wheel secured to an upper crown body or integrally formed gear teeth on an upper crown body.

5. The rocker arm of claim 2, wherein the first lower crown is keyed to the carrier to lock the first lower crown from rotating in the carrier.

6. A rocker arm assembly, comprising:

a valve side arm comprising a rocker arm plate configured with a latch ledge, a valve end, a pivot location in a carrier opening, a pivot pin bore, and a first spring mount;

a deactivating arm comprising a second spring mount, a split portion flanking the latch ledge, a pivot pin pass-through in the split portion, a latch bore, and a latch pin configured to reciprocate in the latch bore;

a pivot pin connecting the pivot pin bore and the pivot pin pass-through; and a lost motion spring positioned between the first spring mount and the second spring mount.

7. The rocker arm assembly of claim 6, wherein the pivot pin bore is over the carrier opening.

8. The rocker arm assembly of claim 6, wherein the pivot pin bore is over the pivot location.

9. The rocker arm assembly of claim 6, further comprising a first spring guide configured to telescope in a second spring guide when the lost motion spring is compressed.

10. The rocker arm assembly of claim 6, wherein the latch bore comprises a spring cup, and wherein a latch spring is seated in the spring cup to bias the latch pin out of the latch bore.

11. The rocker arm assembly of claim 6, further comprising a linear actuator assembly configured to selectively press the latch pin into engagement with the latch ledge.

12. The rocker arm assembly of claim 10, further comprising a linear actuator assembly configured to switch between an engaged state and a disengaged state, wherein the linear actuator assembly is configured to press the latch pin into engagement with the latch ledge in the engaged state, and wherein the linear actuator assembly is configured to release the latch pin from engagement with the latch ledge in the disengaged state.

13. The rocker arm assembly of claim 6, further comprising a rotary actuator assembly configured to selectively press the latch pin into engagement with the latch ledge.

14. The rocker arm assembly of claim 10, further comprising a rotary actuator assembly configured to switch between an engaged state and a disengaged state, wherein the rotary actuator assembly is configured to press the latch pin into engagement with the latch ledge in the engaged state, and wherein the rotary actuator assembly is configured to release the latch pin from engagement with the latch ledge in the disengaged state.

15. A valvetrain assembly comprising the rocker arm assembly of claim 6, the valvetrain assembly comprising a pushrod configured to push the deactivating arm and transfer a valve lift profile through the valve side arm to a valve or valve bridge, wherein, when the latch pin is engaged with the latch ledge at the start of the valve lift profile transfer, the pushrod pushes the deactivating arm so that the latch pin cannot retract from the engagement with the latch ledge, but when the latch pin is released from the latch ledge, the pushrod moves without transferring the valve lift profile to the valve side arm.

* * * * *